US011175054B2

(12) United States Patent
Shaffer

(10) Patent No.: US 11,175,054 B2
(45) Date of Patent: Nov. 16, 2021

(54) MAKE-UP AIR FLOW RESTRICTOR FOR A PACKAGED TERMINAL AIR CONDITIONER UNIT

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 148 days.

(21) Appl. No.: 16/438,677

(22) Filed: Jun. 12, 2019

(65) Prior Publication Data

US 2020/0393143 A1 Dec. 17, 2020

(51) Int. Cl.

| | |
|---|---|
| ***F24F 1/027*** | (2019.01) |
| ***F24F 1/028*** | (2019.01) |
| ***F24F 13/14*** | (2006.01) |

(52) U.S. Cl.

CPC ..... *F24F 1/028* (2019.02); *F24F 1/027* (2013.01); *F24F 13/1486* (2013.01); *F24F 2013/1433* (2013.01)

(58) Field of Classification Search

CPC ..... F24F 1/02; F24F 1/027; F24F 13/1486
USPC ..... 454/143–155, 202, 230, 234–236
See application file for complete search history.

(56) References Cited

U.S. PATENT DOCUMENTS

| | | | | |
|---|---|---|---|---|
| 3,949,808 | A * | 4/1976 | Gilles | F24F 3/056 165/210 |
| 4,480,533 | A | 11/1984 | Bolton et al. | |
| 4,759,196 | A * | 7/1988 | Davis | F24F 1/0007 62/326 |
| 5,788,571 | A * | 8/1998 | Ivison | F24F 7/06 454/249 |
| 5,934,994 | A * | 8/1999 | Wylie | F24F 13/1486 454/333 |
| 6,273,136 | B1 * | 8/2001 | Steinert | B64D 13/02 137/630 |
| 6,497,740 | B1 * | 12/2002 | Moretti | F24F 1/027 55/418 |
| 7,188,481 | B2 | 3/2007 | DeYoe et al. | |
| 7,497,090 | B2 * | 3/2009 | Lee | F24F 1/0007 62/426 |
| 9,821,626 | B2 * | 11/2017 | Wittmann | B60H 1/24 |
| 10,655,881 | B2 * | 5/2020 | Sinha | G08B 21/10 |
| 10,675,947 | B2 * | 6/2020 | Motomura | B60K 37/02 |
| 2011/0097988 | A1 | 4/2011 | Lord | |
| 2014/0045417 | A1 * | 2/2014 | Sakamoto | B60H 1/00028 454/143 |
| 2014/0335774 | A1 * | 11/2014 | Dorland | B60H 1/00685 454/139 |
| 2016/0039389 | A1 * | 2/2016 | Kato | B60H 1/3414 454/127 |

(Continued)

*Primary Examiner* — Vivek K Shirsat
*Assistant Examiner* — Ko-Wei Lin
(74) *Attorney, Agent, or Firm* — Dority & Manning, P.A.

(57) ABSTRACT

A packaged terminal air conditioner unit (PTAC) includes an auxiliary fan configured for urging a flow of make-up air from the outdoor portion into the indoor portion through a vent aperture defined by a bulkhead. A vent door is pivotally mounted over the vent aperture and a flow restrictor extends into the flow of make-up air, the flow restrictor being movable in correlation to a flow rate of the flow of make-up air to increase the flow restriction at higher flow rates of make-up air.

18 Claims, 9 Drawing Sheets

(56) References Cited

U.S. PATENT DOCUMENTS

| | | | | |
|---|---|---|---|---|
| 2017/0087956 | A1* | 3/2017 | Graaf | B60H 1/00921 |
| 2017/0087959 | A1* | 3/2017 | Suzuki | F24F 13/1406 |
| 2017/0198934 | A1* | 7/2017 | Shaffer | F24F 13/14 |
| 2018/0056756 | A1* | 3/2018 | Schaal | B60H 1/3414 |
| 2018/0147911 | A1* | 5/2018 | Woo | B60H 1/00021 |
| 2018/0231266 | A1* | 8/2018 | Fradkin | F24F 13/14 |
| 2018/0334015 | A1* | 11/2018 | Doll | B60H 1/345 |
| 2019/0154278 | A1* | 5/2019 | Jewell | F24F 7/013 |
| 2019/0168583 | A1* | 6/2019 | Dinant | B60H 1/3428 |
| 2019/0186782 | A1* | 6/2019 | Lee | F24F 1/022 |

* cited by examiner

MAKE-UP AIR FLOW RESTRICTOR FOR A PACKAGED TERMINAL AIR CONDITIONER UNIT

FIELD OF THE INVENTION

The present disclosure relates generally to air conditioner units, and more particularly to packaged terminal air conditioner units and features for regulating make-up air.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. PTACs often need to draw air from the outdoor portion into the indoor portion. For example, if a bathroom fan is turned on or air is otherwise ejected from the indoor space, fresh air may be required to supplement or make-up for the lost air.

Accordingly, certain PTACs allow for the introduction of make-up air into the indoor space, e.g., through a vent aperture defined in the bulkhead that separates the indoor and outdoor side of the unit. The vent aperture is usually equipped with an auxiliary fan and/or make-up air module to urge a flow of make-up air from the outdoor side of the PTAC into the conditioned room. In addition, a motorized vent door is pivotally mounted over the vent aperture to control the flow of make-up air.

However, in certain situations, pressure variation within the room may affect the flow rate of make-up air through the vent aperture. For example, if the auxiliary fan is urging air through the vent aperture at a target flow rate when a pressure reduction is generated in the room, e.g., such as when a bathroom fan is turned on, the actual flow rate may exceed the target flow rate.

Accordingly, improved air conditioner units and features for achieving the target make-up flow rate would be useful. More specifically, packaged terminal air conditioner units and make-up air modules that facilitate improved control of make-up air flow rates would be particularly beneficial.

BRIEF DESCRIPTION OF THE INVENTION

Aspects and advantages of the invention will be set forth in part in the following description, or may be apparent from the description, or may be learned through practice of the invention.

In accordance with one embodiment, an air conditioner unit is provided. The air conditioner unit includes a bulkhead defining an indoor portion and an outdoor portion, a vent aperture defined in the bulkhead, and an auxiliary fan positioned proximate the vent aperture and being configured for urging a flow of make-up air from the outdoor portion through the vent aperture to the indoor portion. A vent door is positioned proximate the vent aperture, the vent door being pivotable between an open position for allowing the flow of make-up air through the vent aperture and a closed position for blocking the flow of make-up air through the vent aperture. A flow restrictor extends into the flow of make-up air, the flow restrictor being movable in correlation to a flow rate of the flow of make-up air.

In accordance with another embodiment, an air conditioner unit is provided including a bulkhead including a door frame defining a vent aperture. A vent door is mounted to the door frame over the vent aperture, the vent door being pivotable to regulate a flow of make-up air through the vent aperture. A flow restrictor extends into the flow of make-up air, the flow restrictor being movable to regulate a flow area defined between the door frame, the vent door, and the flow restrictor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
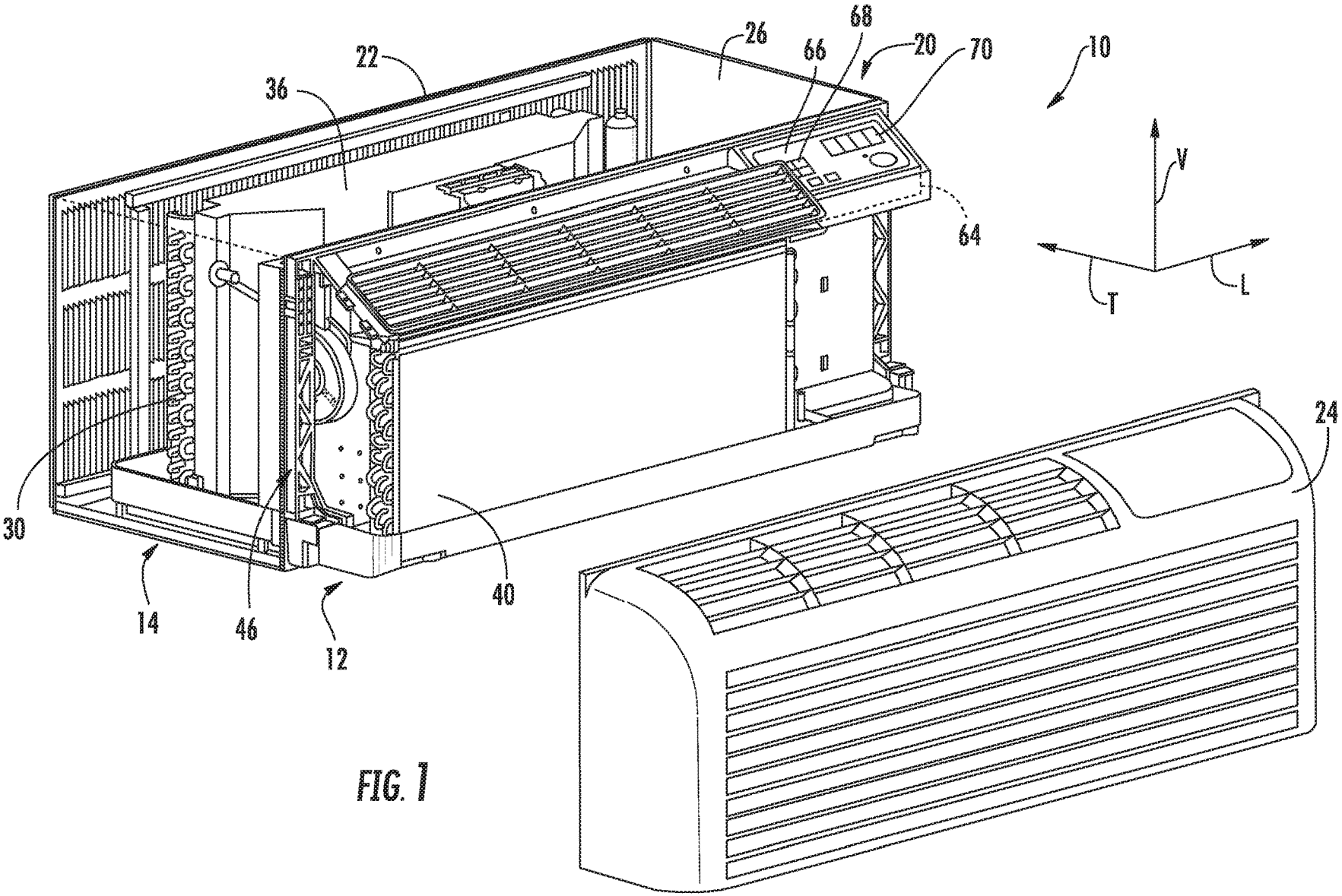
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows. In addition, terms of approximation, such as "approximately," "substantially," or "about," refer to being within a ten percent margin of error.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown.

Figure 2:
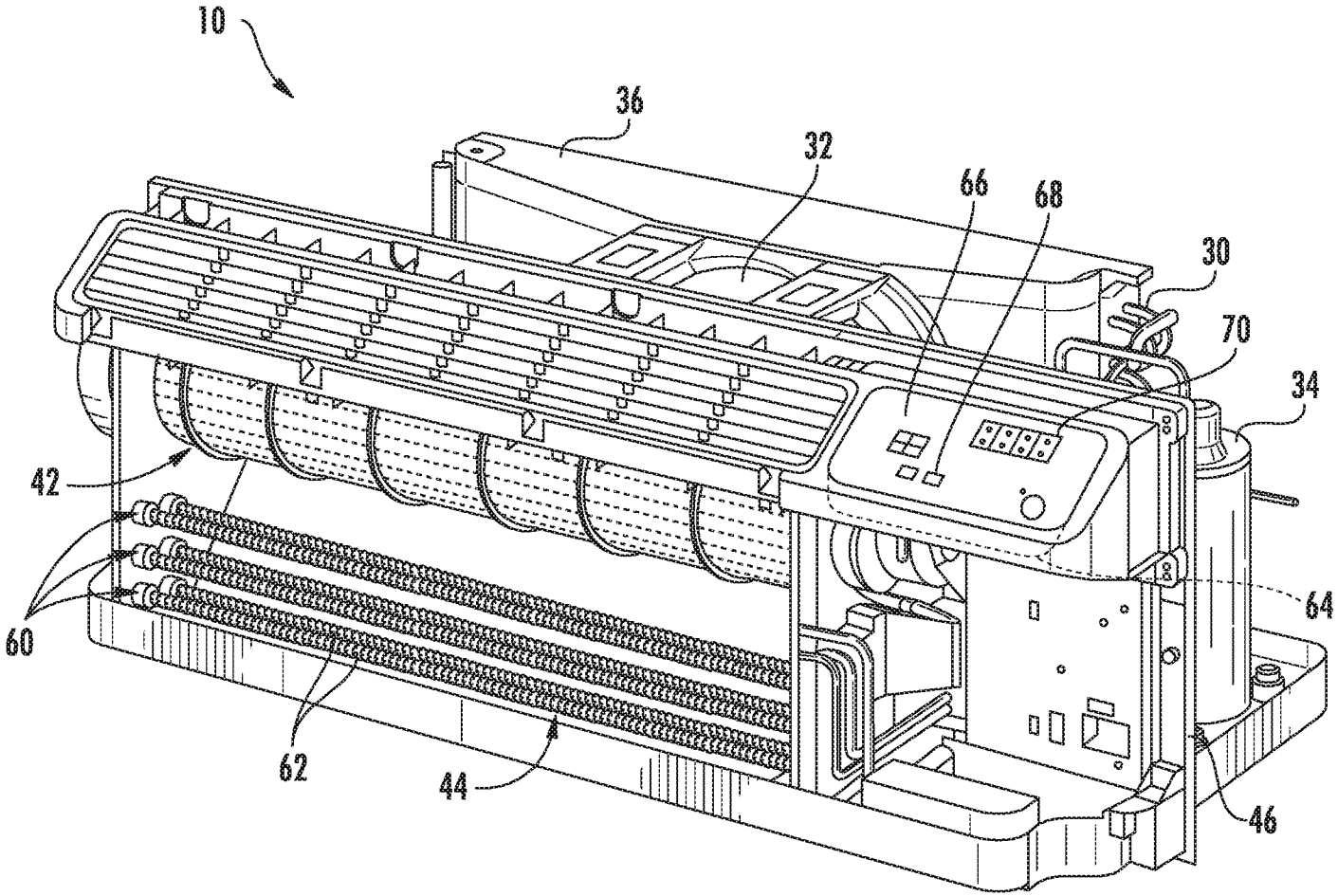
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Figure 3:
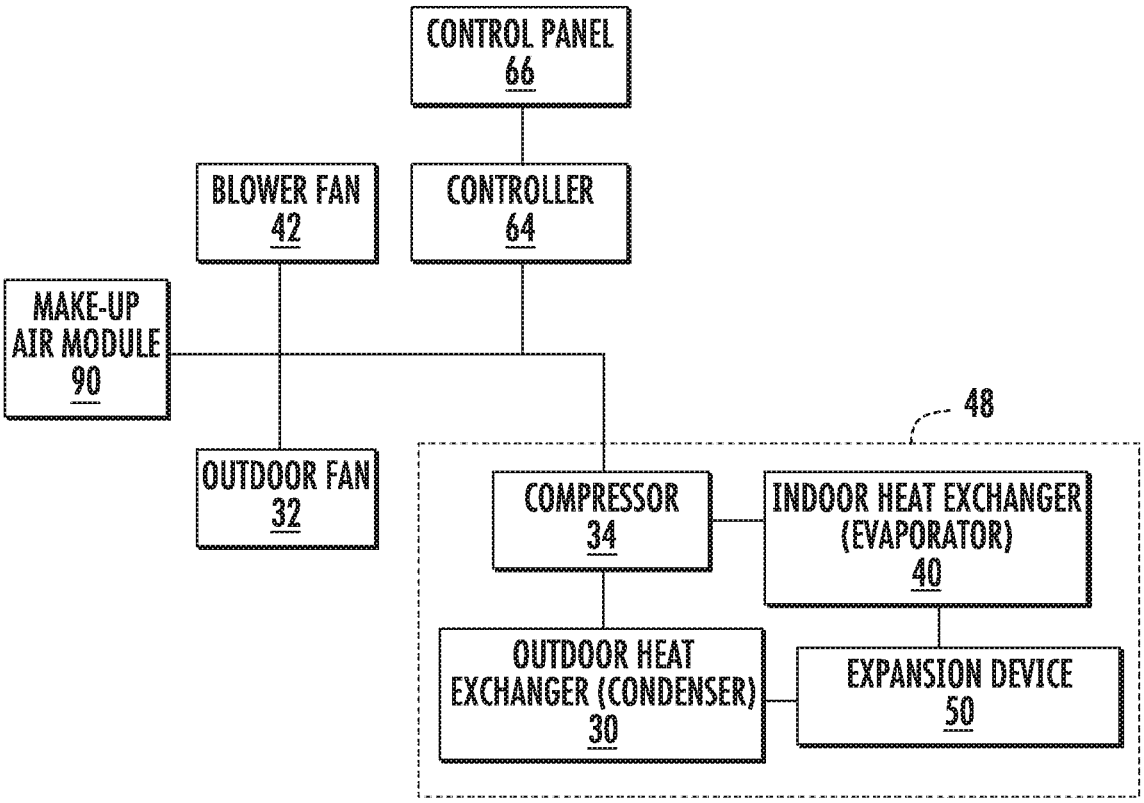
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment of the present subject matter, compressor 34 is a single speed compressor configured for operating at a desirable rated operating speed. However, it should be appreciated that according to alternative embodiments, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be a capillary tube or another suitable expansion device configured for use in a thermodynamic cycle. However, according to alternative embodiments, expansion device may be an electronic expansion valve that enables controlled expansion of refrigerant, as is known in the art. In this regard, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34.

According to the illustrated exemplary embodiment, outdoor fan 32 is an axial fan and indoor blower fan 42 is a centrifugal fan. However, it should be appreciated that according to alternative embodiments, outdoor fan 32 and blower fan 42 may be any suitable fan type. In addition, according to an exemplary embodiment, outdoor fan 32 and blower fan 42 are variable speed fans. For example, outdoor fan 32 and blower fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44. Alternatively, blower fan 42 may be positioned upstream of indoor heat exchanger 40 along the flow direction of indoor air, and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) blower fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
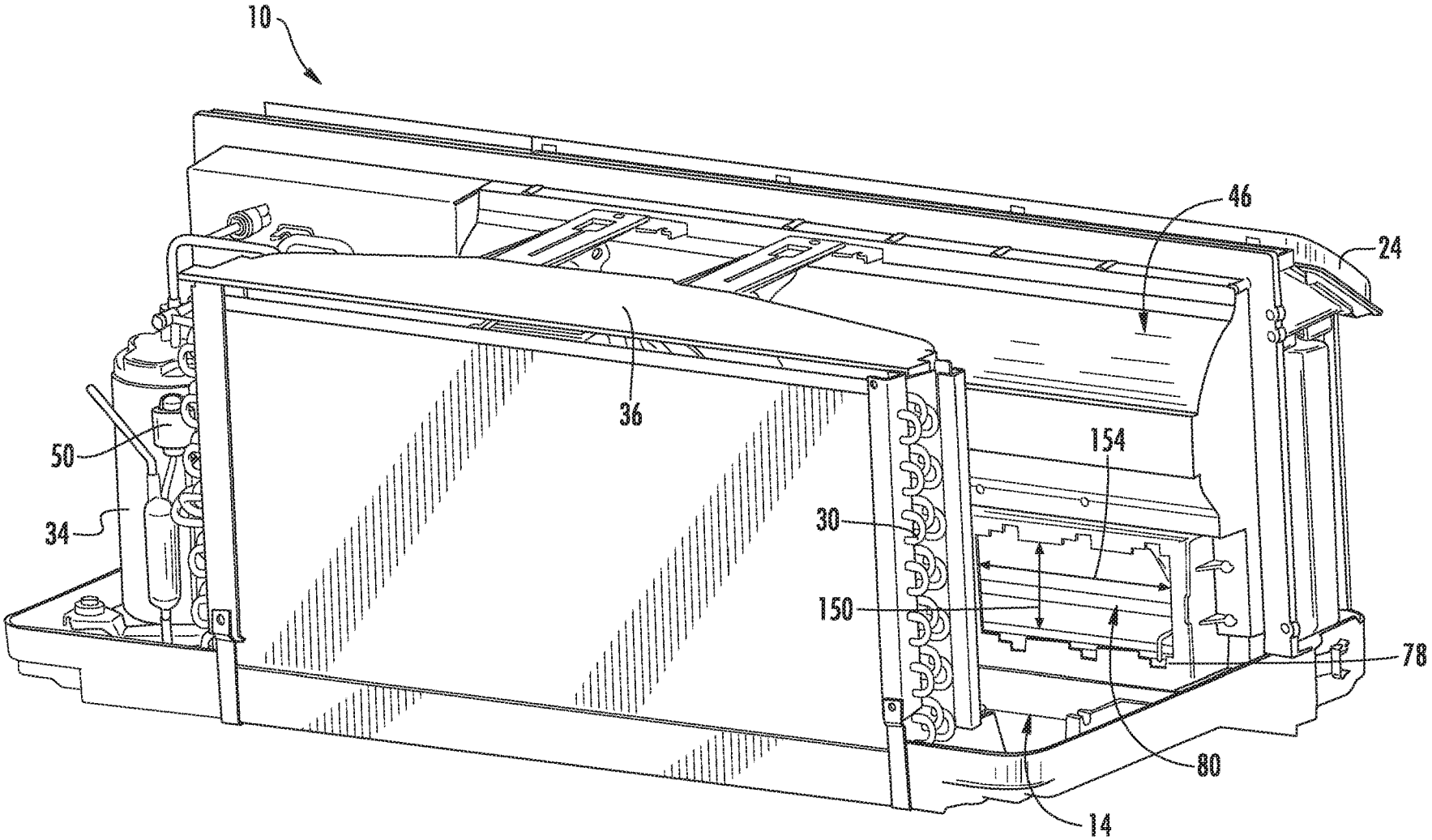
FIG. 4 is a rear perspective view of an outdoor portion of the exemplary air conditioner unit of FIG. 1, illustrating a vent aperture in a bulkhead assembly in accordance with one embodiment of the present disclosure.

Referring briefly to FIG. 4, bulkhead 46 may include define a door frame 78 that surrounds and defines a vent aperture 80 for providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, or to compensate for negative pressure created within the room. In this manner, according to an exemplary embodiment, make-up air may be provided into the room through vent aperture 80 when desired.

Figure 5:
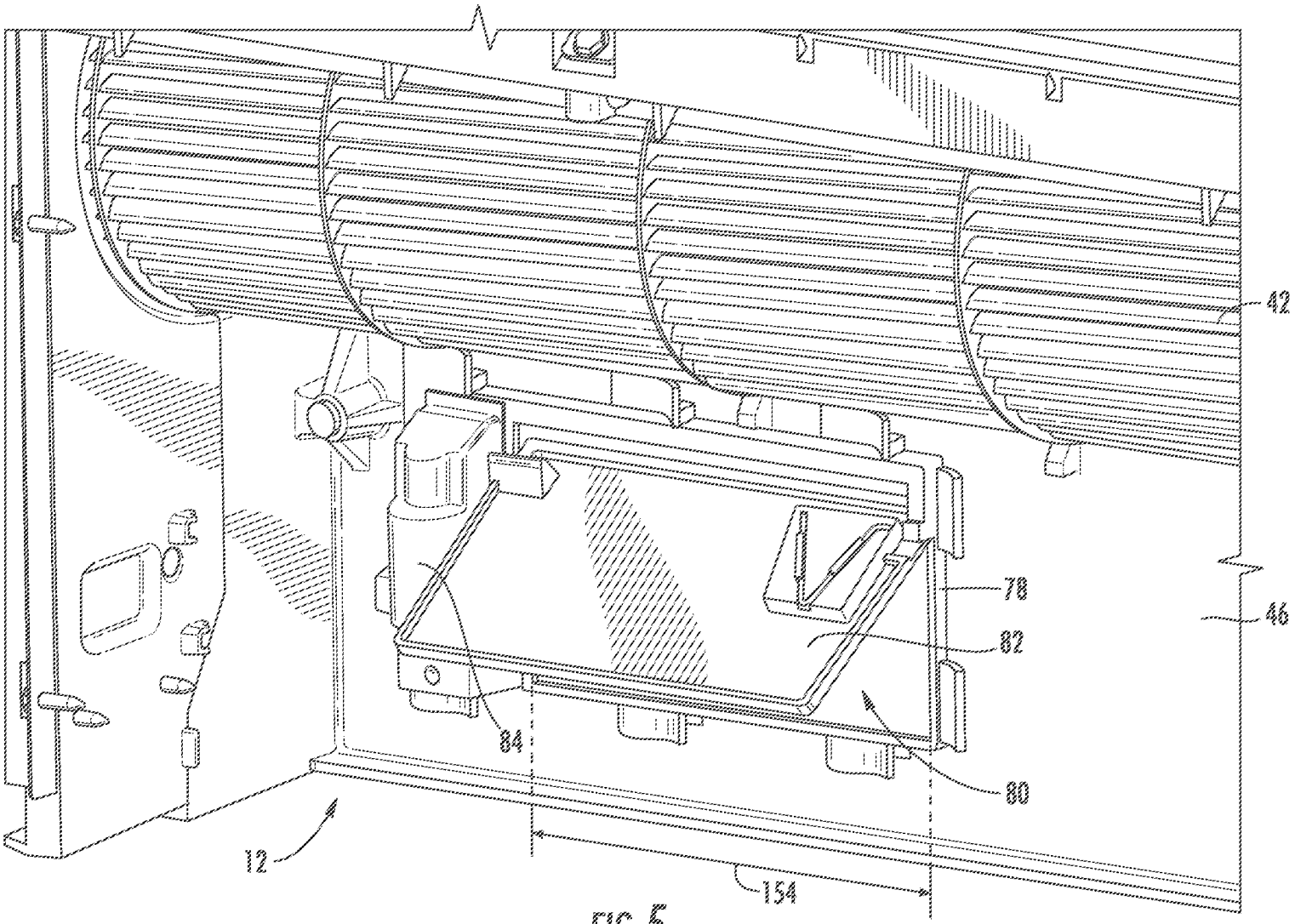
FIG. 5 is a front perspective view of the exemplary bulkhead assembly of FIG. 4 with a vent door illustrated in the open position in accordance with one embodiment of the present disclosure.

As shown in FIG. 5, a vent door 82 may be pivotally mounted to the bulkhead 46 (e.g., directly to door frame 78) proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

Figure 6:
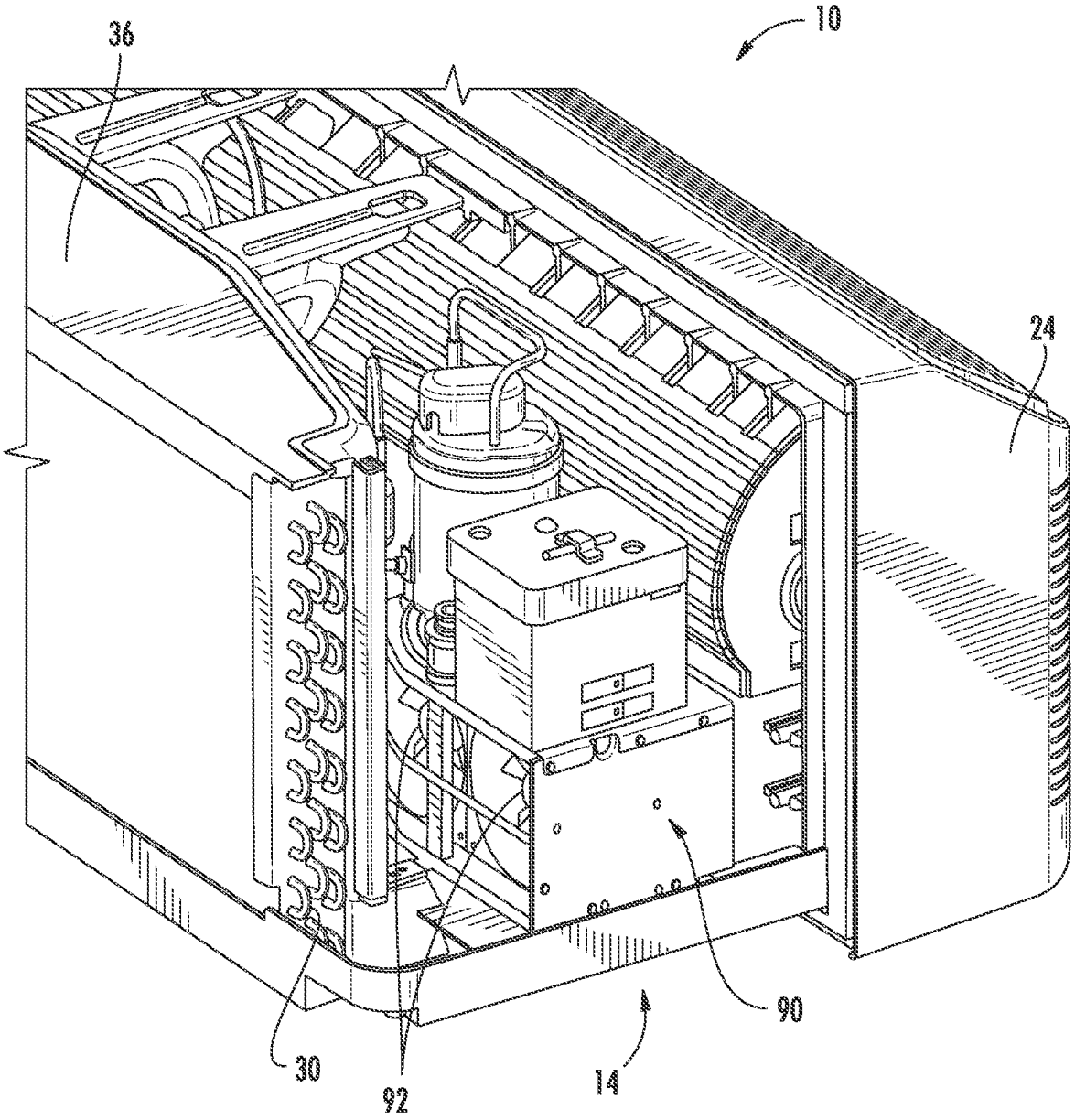
FIG. 6 is a rear perspective view of the exemplary air conditioner unit and bulkhead assembly of FIG. 4 including a sealed system for conditioning make-up air in accordance with one embodiment of the present disclosure.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, as illustrated in FIG. 6, unit 10 may further include an auxiliary sealed system, or make-up air module 90, for conditioning make-up air. As shown, make-up air module 90 and/or an auxiliary fan 92 are positioned within outdoor portion 14 adjacent vent aperture 80 and vent door 82 is positioned within indoor portion 12 over vent aperture 80, though other configurations are possible. According to the illustrated embodiment auxiliary sealed system 90 may be controlled by controller 64, by another dedicated controller, or by any other suitable method.

As illustrated, make-up air module 90 includes auxiliary fan 92 that is configured as part of auxiliary sealed system 90 and may be configured for urging a flow of air (indicated herein by reference numeral 94) through auxiliary sealed system 90. Auxiliary sealed system 90 may further includes one or more compressors, heat exchangers, and any other components suitable for operating auxiliary sealed system 90 similar to refrigeration loop 48 described above to condition make-up air. For example, auxiliary system 90 can be operated in a dehumidification mode, an air conditioning mode, a heating mode, a fan only mode where only auxiliary fan 92 is operated to supply outdoor air, an idle mode, etc.

Referring now generally to FIGS. 7 through 12, various features for regulating a flow rate of the flow of makeup air 94 through vent aperture 80 will be described according to exemplary embodiments of the present subject matter. More specifically, aspects of the present subject matter are directed to various flow restrictors which are intended to restrict the flow of makeup air 94 under certain conditions, e.g., such as when the flow rate increases or exceeds a certain threshold flow rate. Although exemplary configurations of flow restrictors will be described herein and illustrated in the figures, it should be appreciated that these are only exemplary embodiments intended to facilitate explanation of aspects of the present subject matter. Thus, the present subject matter is in no way limited to the embodiments described.

Figure 7:
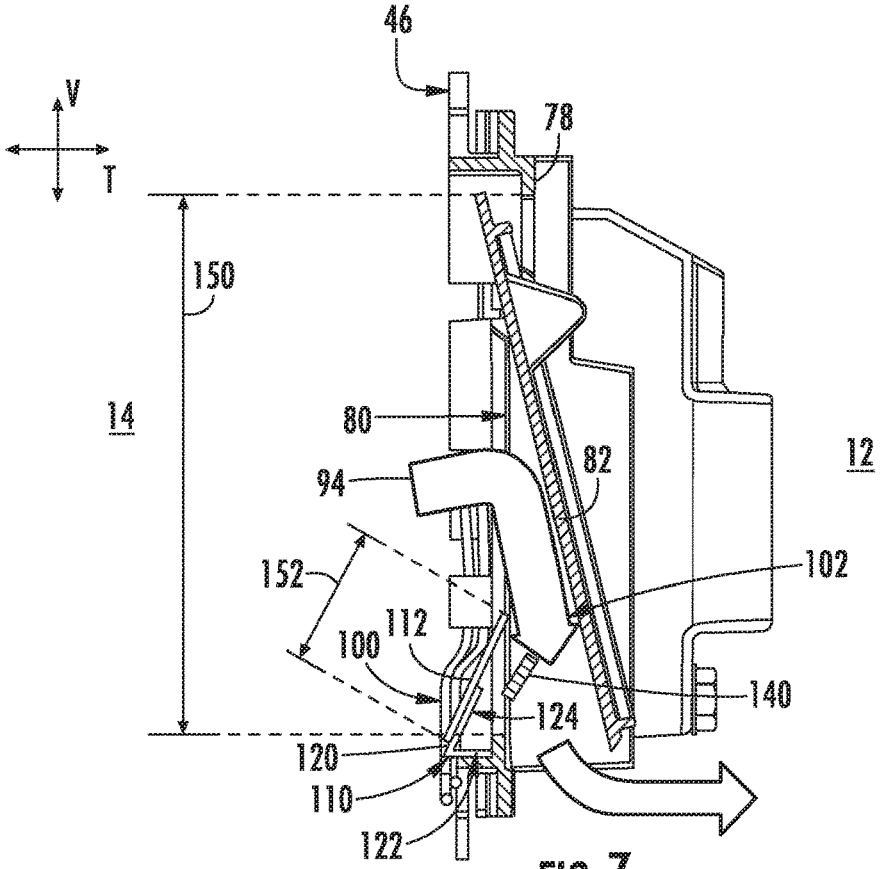
FIG. 7 is a side cross sectional view of the exemplary bulkhead of FIG. 4, with the vent door in an open position and a flow restrictor in a retracted position according to an exemplary embodiment of the present subject matter.
Figure 8:
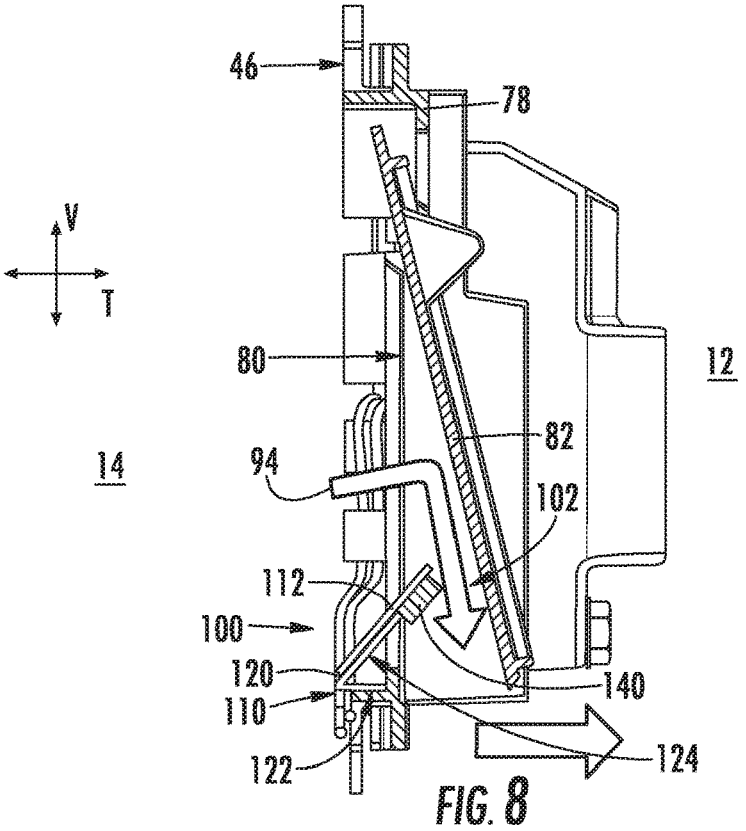
FIG. 8 is a side cross sectional view of the exemplary bulkhead of FIG. 4, with the vent door in an open position and the exemplary flow restrictor of FIG. 7 in an extended position according to an exemplary embodiment of the present subject matter.

Referring now specifically to FIGS. 7 and 8, a flow restrictor 100 will be described according to an exemplary embodiment. Specifically, as illustrated, flow restrictor 100 extends into the flow of makeup air 94 and is movable in response to, or in correlation with, a flow rate of the flow of makeup air 94. In this regard, for example, flow restrictor 100 may pivoted, deflected, or otherwise moved between a retracted position (e.g., as shown in FIG. 7) and an extended position (e.g. as shown in FIG. 8) to selectively permit, restrict, or otherwise regulate a flow rate of the flow of makeup air 94.

According to an exemplary embodiment, the magnitude of pivoting, deflection, or movement of flow restrictor 100 is "correlated" to the makeup air flow rate. In this regard, for example, the movement of the flow restrictor 100 may be directly or indirectly related to the makeup air flow rate. According to one exemplary embodiment, the deflection and/or flow restriction are directly proportional to the makeup air flow rate. In this regard, for example, the deflection of flow restrictor 100, and thus restriction of the flow area, is proportional to the make-up air flow rate. According to other embodiments, the movement of flow restrictor 100 is nonlinearly related to the makeup air flow rate. Although exemplary relationships are described herein, it should be appreciated that the precise configuration and movement of flow restrictor 100 in response to various flow rates may vary while remaining within scope of the present subject matter.

As shown, door frame 78, vent door 82, and flow restrictor 100 may generally define a flow passageway 102 which extends from outdoor portion 14, through vent aperture 80, and into indoor portion 12. The most narrow and restricting portion of flow passageway 102 may be defined between flow restrictor 100 and vent door 82. The term "flow area" may be used herein to refer to the cross sectional flow area of flow passageway 102 at this most restricted portion between flow restrictor 100 and vent door 82. According to exemplary embodiments, flow restrictor 100 is configured for moving to adjust the flow area of flow passageway 102 to achieve desired makeup air flow rates.

For example, flow restrictor 100 may move to restrict flow passageway 102 more at higher flow rates than at lower flow rates. Thus, for example, if the pressure difference across vent aperture 80 would cause the flow of makeup air 94 to pass through vent aperture 80 at first, lower flow rate, e.g., 30 cubic feet per minute (CFM) in the absence of flow restrictor 100, flow restrictor 100 may remain substantially in the retracted state. In this manner, flow passageway 102 is substantially unrestricted such that the actual flow rate remains around 30 CFM. By contrast, if the pressure difference were substantially higher, such that the makeup air flow rate would be 80 CFM in the absence of flow restrictor 100, flow restrictor 100 may be deflected to restrict flow passageway 102 and limit the makeup air flow rate to a lower amount.

According to an exemplary embodiment, flow restrictor 100 may be configured for limiting the makeup air flow rate below a threshold flow rate, e.g., a maximum target flow rate. According to an exemplary embodiment, the target flow rate may be about 37 CFM. According to an exemplary embodiment, flow restrictor 100 may be configured for deflecting to prevent the flow rate from passing the target flow rate or threshold regardless of the pressure difference created across flow aperture 80. According still other embodiments, flow restrictor 100 may be configured for closing altogether in the event flow rates would exceed a high flow threshold in the absence of flow restrictor 100.

Although exemplary values are described herein for the flow rates, it should be appreciated that system configurations may vary these flow rates while remaining within the scope of the present subject matter. Thus, the size and orientation of vent aperture 80, flow passageway 102, and flow restrictor 100 may be adjusted to manipulate the makeup air flow rates, while desirable target thresholds and max flowrates may also be adjusted according to exemplary embodiments. In addition, further restricting features may be defined within flow passageway 102 according to alternative embodiments.

As illustrated in FIGS. 7 and 8, flow restrictor 100 generally includes a resilient element 110 and a flap 112 that is coupled to resilient element 110 and is positioned at least partially within the flow of makeup air 94. According to an exemplary embodiment, the resilient element 110 is generally configured for urging flap 112 toward the retracted position. By contrast, the flow of the makeup air 94 may generally be configured for urging flap 112 toward the extended position, e.g., to restrict the flow of makeup air 94. Thus, resilient element 110 and the flow of makeup air 94 generate opposing forces which move flap 112 of flow restrictor 110 between the retracted and extended positions, thereby regulating the flow rate of the flow of makeup air 94.

According to the illustrated embodiment, flap 112 is a thin rectangular member that is substantially rigid. For example, flap 112 may be formed from a rigid plastic or a piece of sheet metal. According to such an embodiment, the flexibility or mobility of flow restrictor 100 is introduced via resilient element 110. However, it should be appreciated that according to alternative embodiments, resilient element 110 and flap 112 may be a single element with sufficient flexibility to achieve the same purpose. In this regard, alternative embodiments could use a single piece of spring steel or other pliable material formed to have a suitable shape and resiliency to deflect into flow passageway 102 under the force of the flow of makeup air 94 and spring back to the retracted position under relatively low flow rates.

According to the specific embodiment illustrated in FIGS. 7 and 8, resilient element 110 is a mechanical reed, a leaf spring plate 120, or another suitable mechanical spring member. As illustrated, the spring plate 120 is attached at a first end portion 122 and defines a second end portion or cantilevered portion 124 which is cantilevered away from door frame 78, e.g., into and toward flow passageway 102. According to the illustrated embodiment, flap 112 is coupled to cantilevered portion 124 such that it is not in direct contact with bulkhead 46 or door frame 78. Specifically, as illustrated, leaf spring plate 120 extends from first end portion 122 along the door frame 78 along the transverse direction T (e.g., from indoor portion 12 toward outdoor portion 14). Leaf spring plate 120 then extends upward and back toward indoor portion 12 such that flap 112 extends into flow passageway 102. Other positions and orientations of leaf spring plate 120 are possible and within scope of the present subject matter.

During operation of PTAC 10 and makeup air module 90, the flow of makeup air 94 may pass through the aperture 80 at various flowrates. If the makeup air flow rate is relatively low, resilient element 110 will maintain flap 112 in a retracted position (e.g., as shown in FIG. 7). By contrast, as the makeup air flow rate increases, the force generated by the flow of makeup air 94 on flap 112 may deflect resilient element 110 such that a flow area of flow passageway 102 is decreased and the overall flow rate is restricted. The position, size, and resiliency of resilient element 110 and/or flap 112 may be selected to limit the makeup air flow rate to desired maximum flowrates or target flowrates.

Figure 9:
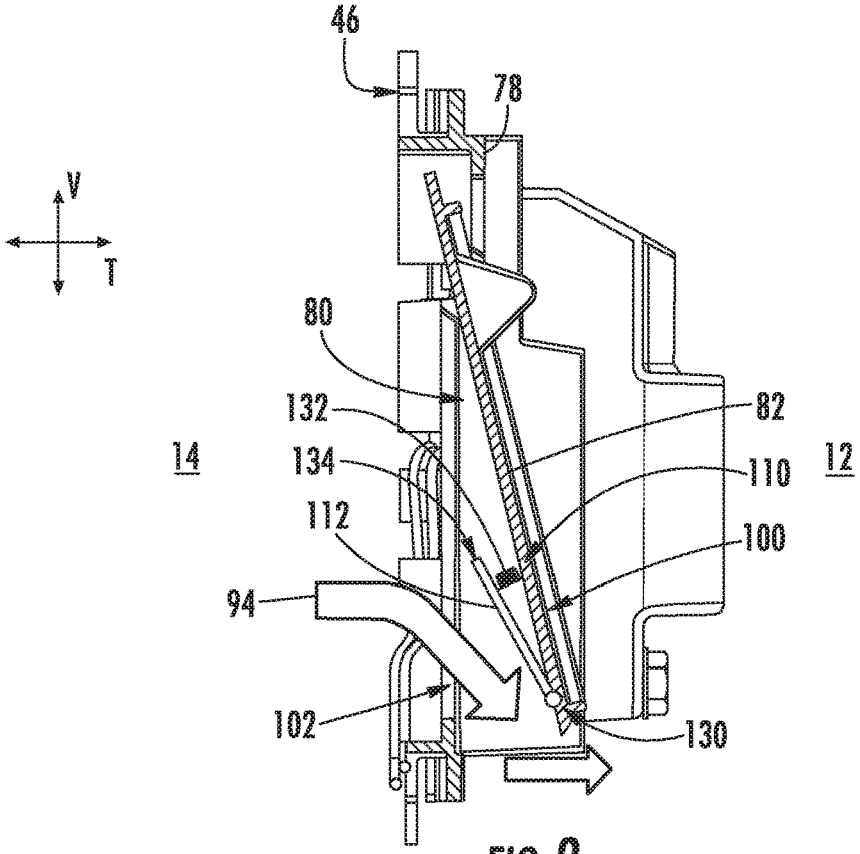
FIG. 9 is a side cross sectional view of the exemplary bulkhead of FIG. 4, with the vent door in an open position and a flow restrictor in a retracted position according to an exemplary embodiment of the present subject matter.
Figure 10:
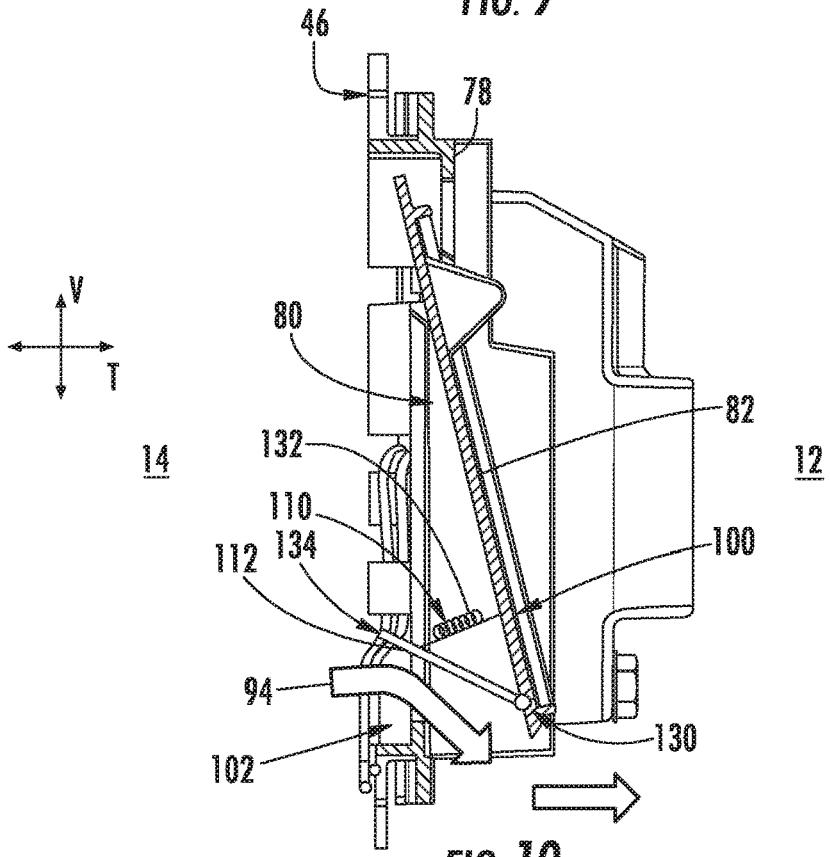
FIG. 10 is a side cross sectional view of the exemplary bulkhead of FIG. 4, with the vent door in an open position and the exemplary flow restrictor of FIG. 9 in an extended position according to an exemplary embodiment of the present subject matter.

Referring now to FIGS. 9 and 10, an alternative embodiment of flow restrictor 100 will be described according to an exemplary embodiment of the present subject matter. Due to the similarity between embodiments, like reference numerals may be used to refer to the same or similar features. In general, this embodiment of flow restrictor 100 includes a coil spring and pivotally mounted flap mounted to vent door 82. However, it should be appreciated that a similar coil spring/pivoting flap embodiment may be mounted to bulkhead 46, door frame 78, makeup air module 90, or any other portion of PTAC 10 to support flow restrictor 100 within flow passageway 102.

As shown, flap 112 is pivotally mounted to a bottom end 130 of vent door 82 and extends upstream into flow of makeup air 94. In addition, resilient element 110 is a mechanical coil spring 132 extending between vent door 82 and flap 112. More specifically, mechanical coil spring 132 is mounted to a distal end 134 of flap 112 for urging flap 112 toward a retracted position (e.g., as shown in FIG. 9) where it is substantially flat against vent door 82 (or is pivoted at a slight angle to scoop a portion of the flow of makeup air 94). By contrast, as the flow rate of the flow of makeup air 94 increases, flap 112 is urged toward an extended position (e.g., as shown in FIG. 10), such that mechanical coil spring 132 is extended. In this manner, flow restrictor 100 as illustrated in FIGS. 9 and 10 operates similar to flow restrictor 100 illustrated in FIGS. 7 and 8 to decrease a flow area of flow passageway 102 to limit the flow rate of the flow of makeup air 94.

According to an exemplary embodiment of the present subject matter, flow restrictor 100 may further include a mechanical stop 140 which is generally configured for stopping the deflection of flow restrictor 100 at a certain desirable position or angle. In this regard, as illustrated for example in FIGS. 7 and 8, mechanical stop 140 may be a physical rib or protruding member that engages flap 112 at the desired maximum deflection point or threshold angle. In this manner, mechanical stop 140 may prevent flow restrictor 100 from sealing off flow passageway 102 altogether in the event of very high flowrates. Although the mechanical stop 140 is illustrated herein as a physical rib or protruding feature, it should be appreciated that mechanical stop 140 may be any other suitable member for preventing motion of flap 112 past a specific threshold. For example, according to another embodiment, mechanical stop 140 may be a fixed length and non-extendable string or strap that extends from a fixed location to flap 112 to prevent motion past a specific point. Other variations and modifications may be made while remaining within the scope of the present subject matter.

As explained herein, the sizes and shapes of vent aperture 80, flow passageway 102, and flow restrictor 100 may vary to adjust the flowrates through flow passageway 102. For example, according to an exemplary embodiment, vent aperture defines an aperture height 150 measured along the vertical direction V and flow restrictor 100 defines a restrictor height 152. According to an exemplary embodiment, restrictor height 152 may be greater than 10%, greater than 20%, greater than 40%, or greater than 50% of aperture height 150. In addition, restrictor height 152 may be less than 90%, less than 60%, less than 40%, or less than 10% of aperture height 150. Other restrictor heights 152 are possible and within scope of the present subject matter.

In addition, according to an exemplary embodiment, vent aperture 80 may define an aperture width 154 (see, e.g., FIG. 4) measured along the lateral direction L and flow restrictor may define a restrictor width 156 (see, e.g., FIG. 12) also measured along the lateral direction L. To the exemplary embodiment, aperture width 154 is substantially equivalent to restrictor width 156. However, according to alternative embodiments, restrictor width 156 may be less than aperture width 154, such as about 90%, 70%, or 50% of aperture width 154.

Figure 11:
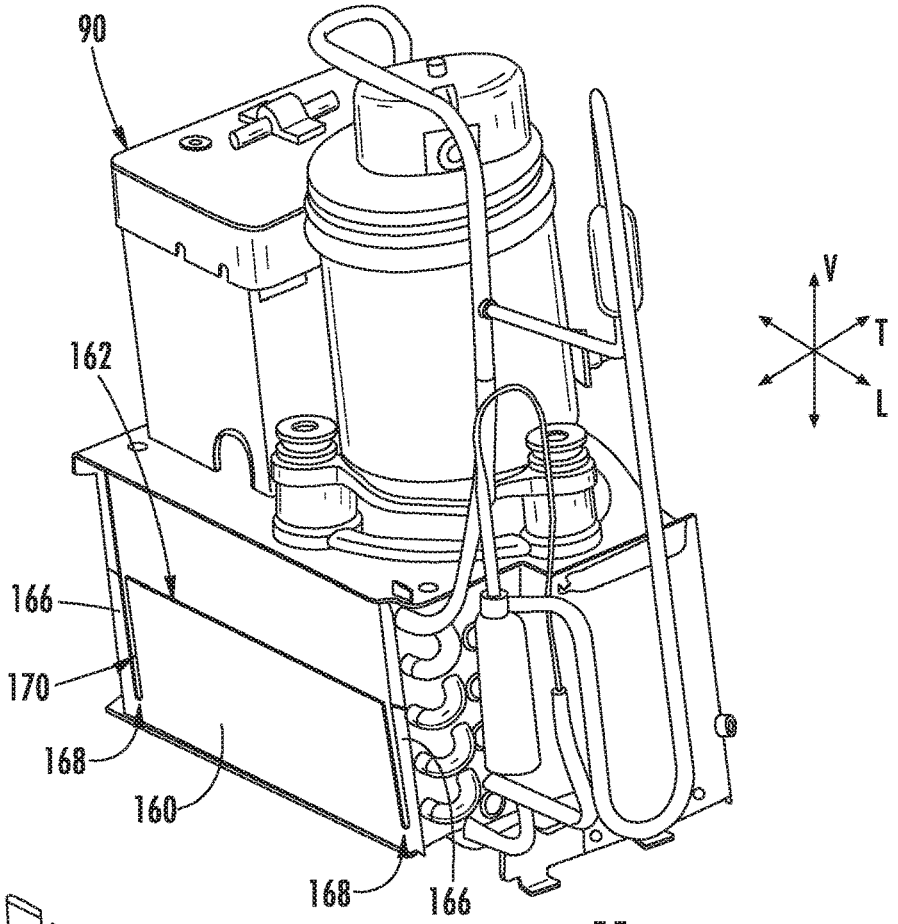
FIG. 11 is a perspective view of a make-up air module that may be used with the exemplary air conditioner unit of FIG. 1, including a flow restrictor plate according to an exemplary embodiment of the present subject matter.
Figure 12:
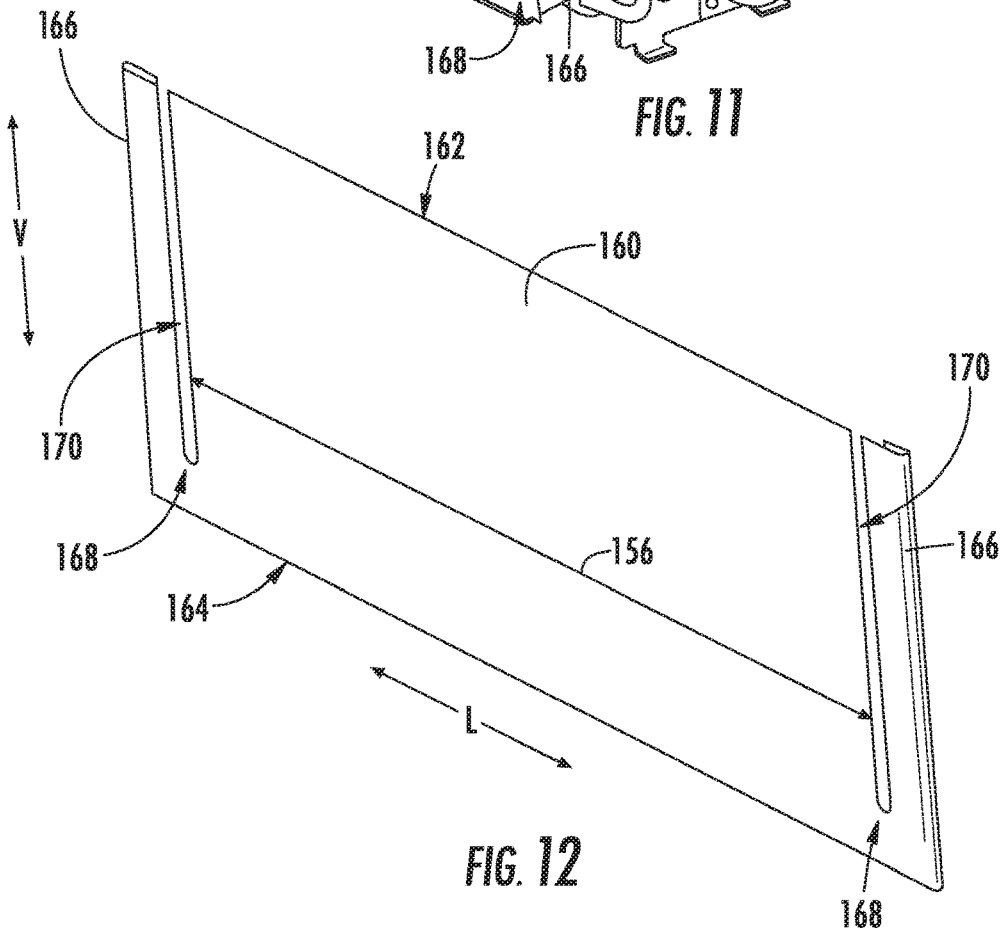
FIG. 12 is a perspective view of the exemplary flow restrictor plate of FIG. 11 according to an exemplary embodiment of the present subject matter.

Referring now to FIGS. 11 and 12, flow restrictor 100 will be described according to still another embodiment of the present subject matter. As illustrated, flow restrictor 100 is a single stamped plate that includes or defines a primary flow plate 160 that extends between a top portion 162 and a bottom portion 164. In addition, two vertical side members 166 are positioned on laterally opposite ends of flow plate 160 such that flow plate 160 is coupled to the side members 166 through resilient members or connectors 168 at bottom portion 164 of flow restrictor 100. In this manner, top portion 162 of flow plate 160 may flex relative to the bottom portion 164, while side members 166 are mounted to a flange of makeup air module 190 to maintain the position of flow restrictor 100. It should be appreciated that the size of slots 170 positioned between flow plate 160 and side members 166 may vary, as may the size of resilient connectors 168 to adjust the rigidity or flexibility of flow restrictor 100. In addition, flow plate 160 may be made itself of any suitable resilient material or may be thin enough to permit some amount of flexing to facilitate the desired flow restriction.

As illustrated in the various embodiments from FIGS. 7 through 12, flow restrictor 100 may be mounted in any suitable location and configuration for extending into flow passageway 102 and restricting the flow of makeup air 94. For example, as shown in FIGS. 7 and 8, resilient element 110 extends from bulkhead 46 (e.g., from doorframe 78) proximate vent aperture 80. By contrast, according to alternative embodiments illustrated in FIGS. 9 and 10, resilient element 110 extends from vent door 82, e.g., on the portion of the door 82 facing outdoor portion 14. According still other embodiments, flow restrictor 100 may be mounted directly to makeup air module 90 prior to installation onto bulkhead 46, e.g., such as illustrated in FIG. 11. It should be appreciated that other mounting positions and configurations are possible and within the scope of the present subject matter. In addition, it should be appreciated that features and configurations of the various flow restrictors described herein may be used for each of the specific mounting positions and configurations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

a bulkhead separating an indoor portion and an outdoor portion of the air conditioner unit;

a vent aperture defined in the bulkhead;

an auxiliary fan positioned proximate the vent aperture and being configured for urging a flow of make-up air from the outdoor portion through the vent aperture to the indoor portion;

a vent door positioned proximate the vent aperture, the vent door being pivotable between an open position for allowing the flow of make-up air through the vent aperture and a closed position for blocking the flow of make-up air through the vent aperture; and a flow restrictor extending into the flow of make-up air, the flow restrictor being movable in correlation to a flow rate of the flow of make-up air.

2. The air conditioner unit of claim 1, wherein the flow restrictor comprises:

a resilient element; and a flap coupled to the resilient element and being positioned at least partially within the flow of make-up air, the resilient element being configured for urging the flap toward a retracted position.

3. The air conditioner unit of claim 2, wherein the resilient element extends from the bulkhead proximate the vent aperture.

4. The air conditioner unit of claim 2, wherein the resilient element extends from the vent door.

5. The air conditioner unit of claim 2, wherein the flap is pivotally mounted to the bulkhead and the resilient element extends between the bulkhead and the flap.

6. The air conditioner unit of claim 2, wherein the flap is pivotally mounted to the vent door and the resilient element extends between the vent door and the flap.

7. The air conditioner unit of claim 2, wherein the resilient element comprises a cantilevered portion and the flap being coupled to the cantilevered portion and not in direct contact with the bulkhead.

8. The air conditioner unit of claim 1, further comprising:

a mechanical stop for preventing the flow restrictor from pivoting past a threshold angle.

9. The air conditioner unit of claim 1, wherein the vent aperture defines an aperture height and the flow restrictor defines a restrictor height, the restrictor height being greater than 20% of the aperture height.

10. The air conditioner unit of claim 1, wherein the vent aperture defines an aperture width and the flow restrictor defines a restrictor width, the restrictor width substantially equivalent to the aperture width.

11. The air conditioner unit of claim 1, wherein the flow restrictor comprises:

a plate having a top portion to a bottom portion; and a vertical side member spaced apart from the plate by a slot and coupled to the plate by a resilient connector positioned at the bottom portion of the plate to such that the top portion of the plate is configured to flex relative to the bottom portion of the plate.

12. The air conditioner unit of claim 1, wherein a door frame, the vent door, and the flow restrictor define a flow passageway, and wherein the flow restrictor moves to restrict the flow passageway more at a higher flow rate of the flow of make-up air than at a lower flow rate of the flow of make-up air.

13. The air conditioner unit of claim 1, wherein the flow restrictor is configured for limiting the flow rate to a target flow rate.

14. The air conditioner unit of claim 13, wherein the target flow rate is about 37 cubic feet per minute.

15. The air conditioner unit of claim 1, further comprising:

a make-up air module having the auxiliary fan and positioned adjacent the vent aperture for conditioning the flow of air.

16. The air conditioner unit of claim 15, wherein the flow restrictor is mounted to the make-up air module prior to installation onto the bulkhead.

17. An air conditioner unit, comprising:

a bulkhead comprising a door frame defining a vent aperture;

a vent door mounted to the door frame over the vent aperture, the vent door being pivotable to regulate a flow of make-up air through the vent aperture; and a flow restrictor extending into the flow of make-up air, the flow restrictor being movable to regulate a flow area defined between the door frame, the vent door, and the flow restrictor, wherein the flow restrictor comprises:

a resilient element extending from the door frame; and a flap coupled to the resilient element and being positioned at least partially within the flow of make-up air, the resilient element being configured for urging the flap toward a retracted position.

18. The air conditioner unit of claim 17, wherein the flow restrictor comprises:

a resilient element extending from the vent door; and a flap coupled to the resilient element and being positioned at least partially within the flow of make-up air, the resilient element being configured for urging the flap toward a retracted position.

* * * * *